US005752301A

United States Patent [19]

Fehrer

[11] Patent Number: 5,752,301

[45] Date of Patent: May 19, 1998

[54] APPARATUS FOR NEEDLING A FIBROUS WEB

[76] Inventor: Ernst Fehrer, Auf der Gugl 28, A-4020 Linz, Austria

[21] Appl. No.: 729,492

[22] Filed: Oct. 11, 1996

[30] Foreign Application Priority Data

| | | | |
|---|---|---|---|
| Oct. 16, 1995 | [AT] | Austria | 1714/95 |
| Nov. 27, 1995 | [AT] | Austria | 1933/95 |
| Jan. 25, 1996 | [AT] | Austria | 125/96 |

[51] Int. Cl.[6] ..... D04H 18/00

[52] U.S. Cl. ..... 28/115

[58] Field of Search ..... 28/101, 111, 115, 28/116, 117, 104, 105, 106, 107, 108, 109, 110

[56] References Cited

U.S. PATENT DOCUMENTS

| | | | |
|---|---|---|---|
| 3,473,205 | 10/1969 | Zocher | 28/107 |
| 4,035,881 | 7/1977 | Zocher | 28/112 |
| 5,148,584 | 9/1992 | Fehrer | 28/115 |
| 5,384,944 | 1/1995 | Minichshofer | 28/115 |

FOREIGN PATENT DOCUMENTS 234 043 3/1986 Germany .

*Primary Examiner*—C. D. Crowder
*Assistant Examiner*—Larry D. Worrell, Jr.
*Attorney, Agent, or Firm*—Collard & Roe, PC.

[57] ABSTRACT

In an apparatus for needling a fibrous web passing through the apparatus in one direction, which comprises a needle board driven back and forth in a needling direction, and a support opposite the needle board and having a surface facing the needle board, the support surface comprises surface sections inclined in different directions with respect to the needling direction transversely to the one direction and further surface sections following the surface sections in the one direction and inclined in opposite directions.

10 Claims, 3 Drawing Sheets

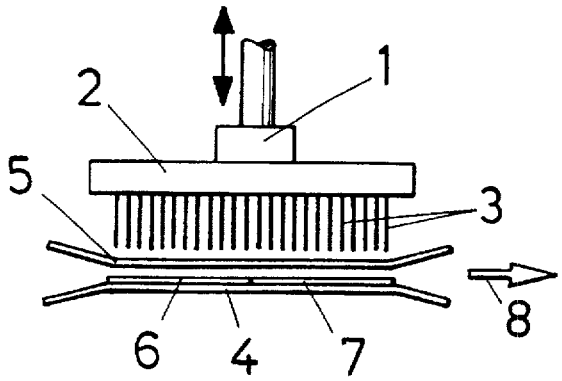
FIG.1
FIG.2
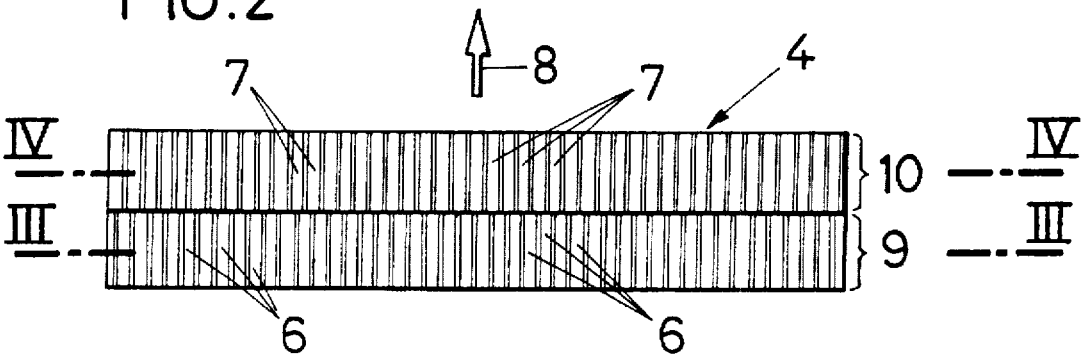
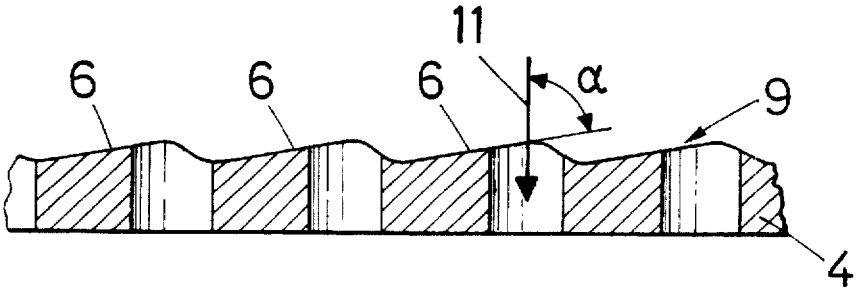
FIG.3
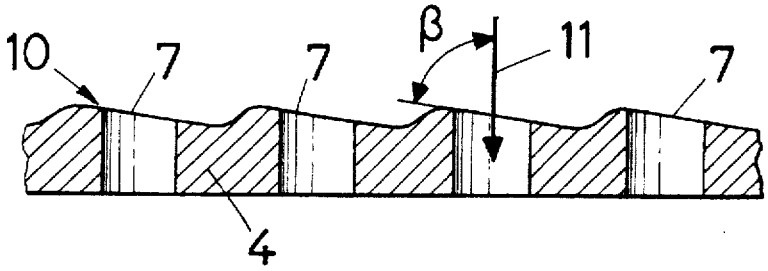
FIG.4

APPARATUS FOR NEEDLING A FIBROUS WEB

BACKGROUND OF THE INVENTION

1. Field of the Invention

The present invention relates to an apparatus for needling a fibrous web passing through the apparatus in one direction, which comprises a needle board driven back and forth in a needling direction, and a support opposite the needle board and having a surface facing the needle board.

2. Description of the Prior Art

To impart higher strength to a needled fibrous web, it is known to needle the web in a direction inclined opposite to the direction in which the fibrous web passes through the apparatus, rather than perpendicularly to the surface of the web. For this purpose, the web guidance formed by the support and a stripper defines in the range of the needles an ascending inlet section and an oppositely inclined, descending outlet section in the direction of the passage of the fibrous web. A transition section outside the range of the needles connects the inlet and outlet sections. Correspondingly, the needle board reciprocating in a needling direction is roof-shaped and carries needles only in the range of the inclined inlet and outlet sections. Accordingly, the fibrous web is needled in these sections in directions inclined with respect to the direction in which the web passes through the apparatus. This limitation of the needling to the inclined inlet and outlet sections restricts the needling density, which counteracts the desire of obtaining a higher web strength. In addition, the inclination of the needling exclusively in a direction inclined to the web surface in the direction of the passage of the web instead of the conventionally perpendicular orientation causes a loss in the transverse strength of the needled web.

SUMMARY OF THE INVENTION

To meet the requirement of a fibrous web of high transverse strength, as desired for many uses, it is a primary object of this invention to provide a structurally simple improvement of an apparatus of the first-described type, with which needled fibrous webs of high transverse strength may be produced.

The above and other objects are accomplished according to the invention with a support surface comprising surface sections inclined in different directions with respect to the needling direction transversely to the one direction and further surface sections following the first-named surface sections in the one direction and inclined in opposite directions.

Since the fibrous web is pressed against the support surface during needling, the surface sections inclined transversely to the direction of passage of the web produce correspondingly inclined needling channels into the fibrous web. This leads to an increased felting in the direction of the width of the web, because an intersecting needling of the fibrous web transversely to the direction of passage of the web is caused by following further surface sections inclined in opposite directions. In this manner, a high transverse strength of the needled fibrous web is assured and the usual transverse shrinkage encountered during needling is counteracted. Although the needling conditions are such that only the support surface facing the needle board need be provided with the inclined surface sections, it may be advantageous under some circumstances to provide a surface of a stripper arranged between the needle board and the support and facing the fibrous web with corresponding inclined surface sections to obtain withdrawal paths for the needles which conform to the entry paths.

Various forms and arrangements of the inclined surface sections and further surface sections are possible as long as these surface sections are inclined relative to the needles transversely to the direction of passage of the web. However, according to a preferred embodiment, the surface sections and oppositely inclined further surface sections are arrayed in two rows adjoining in the one direction and extending transversely thereto. Depending on the selected number of the support surface sections, the deflection of the web in a direction extending transversely to the web surface may be relatively insignificant so that no special constructions of the needle board or of the needles are required.

According to a preferred feature assuring a very advantageous transverse strength of the needle web, additional surface sections adjoining the surface sections in the one direction extend perpendicularly to the needling direction. These additional surface sections may precede or follow the inclined surface sections in the one direction so that the needling in an inclined direction overlaps needling in a perpendicular direction.

The differently inclined surface sections may be arranged on a one-piece support but the construction will be facilitated if the support is comprised of several separate parts each carrying selected groups of surface sections. It is, therefore, advantageous if the surface sections and further surface sections are provided on separate parts of the support. The needling results may be changed by suitably combining such support parts.

According to another preferred embodiment, ribs extending in the one direction define the surface sections, the ribs having changing heights in this direction. This produces needle entry channels inclined in the one direction, which provides better felting in a direction of the length of the fibrous web and thus a higher longitudinal web strength. While there are no fundamental limitations to the arrangement and distribution of the ribs, particularly simple construction conditions are obtained if the ribs with corresponding heights are arrayed side-by-side transversely to the one direction. Such an embodiment makes it possible to obtain sequential needling effects in the first direction, caused by the specific positions of the needle entry channels. This occurs particularly if two sequential rows of ribs are arranged in the one direction. Rows of ribs adjoining in the one direction may have heights uniformly inclined in this direction so that a constant rise of the ribs over the entire length of the web guidance is obtained despite a limited maximum height of the ribs. The ribs of sequential rows may provide different effects, for instance, if at least two rows of the ribs have respectively ascending and descending heights in the one direction.

Finally, the strength of the needled fibrous web in the longitudinal direction thereof may be improved by imparting to the support surface a steady curvature in the one direction. This provides different inclinations of the web surface relative to the needling direction in the direction of the passage of the web through the apparatus, which influences the lengthwise strength. The steady curvature, which need not be uniform, provides for a particularly uniform needling.

BRIEF DESCRIPTION OF THE DRAWING

The above and other objects, advantages and features of the present invention will become more apparent from the following detailed description of certain now preferred embodiments thereof, taken in conjunction with the accompanying schematic drawing wherein FIG. 1 is a simplified side elevational view showing a needling apparatus of this invention;

FIG. 2 is a top view of one embodiment of the support surface according to the invention;

FIG. 3 is a section along line III—III of FIG. 2, on an enlarged scale;

FIG. 4 is a section along line IV—IV of FIG. 2, on an enlarged scale;

DETAILED DESCRIPTION OF PREFERRED EMBODIMENTS

Figure 5:
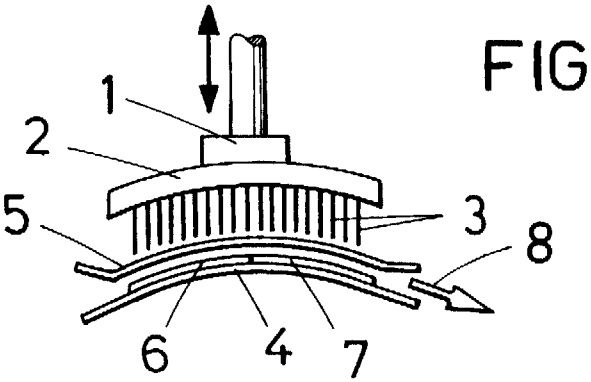
FIG. 5 is a simplified side elevational view showing another embodiment of the needling apparatus of this invention.

Referring now to the drawing, wherein like reference numerals refer to like parts functioning in a like manner in all figures, FIGS. 1 to 4 show an apparatus for needling a fibrous web passing through the apparatus in one direction, which comprises needle board 2 affixed to needle beam 1 driven back and forth in a needling direction indicated by a double-headed arrow, and support 4 opposite the needle board and having a surface facing the needle board. Needles 3 needle a fibrous web passing in the one direction indicated by arrow 8 between stripper 5 and support 4. Stripper 5 and support 4 are perforated plates through whose bores needles 3 pass as the needle board is reciprocated.

In contrast to conventional support surfaces guiding the web, the support surface of the present invention comprises surface sections 6 inclined in different directions with respect to the needling direction transversely to the one direction and further surface sections 7 following surface sections 6 in the one direction and inclined in opposite directions. As shown in FIG. 2, surface sections 6 and oppositely inclined further surface sections 7 are arrayed in two rows 9 and 10 adjoining in the one direction and extending transversely to the one direction indicated by arrow 8. As illustrated in FIGS. 3 and 4, surface sections 6 and further surface sections 7 respectively enclose angles $\alpha$ and $\beta$ with the needling direction indicated by arrow 11. These angles need not be the same. It is only required that surface sections 6 and oppositely inclined further surface section 7 follow each other in the one direction indicated by arrow 8 to assure an intersecting needling of the fibrous web in a transverse direction.

As is obvious from FIGS. 3 and 4, inclined surface sections 6 and further surface sections 7 of the surface of support 4 provide a support for a fibrous web passing through the apparatus, which forces the needles to punch through the web at angles $\alpha$ and $\beta$ inclined relative to the surface of the web. This results in a desired increase in the transverse strength of the needled fibrous web.

If it is additionally desired to increase the longitudinal strength of the needled fibrous web, the web guidance in the one direction indicated by arrow 8 is curved by imparting to the support surface a steady curvature in the one direction, as shown in FIG. 5. In this embodiment, support 4, stripper 5 and needle board 2 are correspondingly curved. This provides similarly advantageous needling channels, but in the one direction rather than transversely thereto. The steady curvature provides also a needling in a direction perpendicular to the surface of the web.

Figure 6:
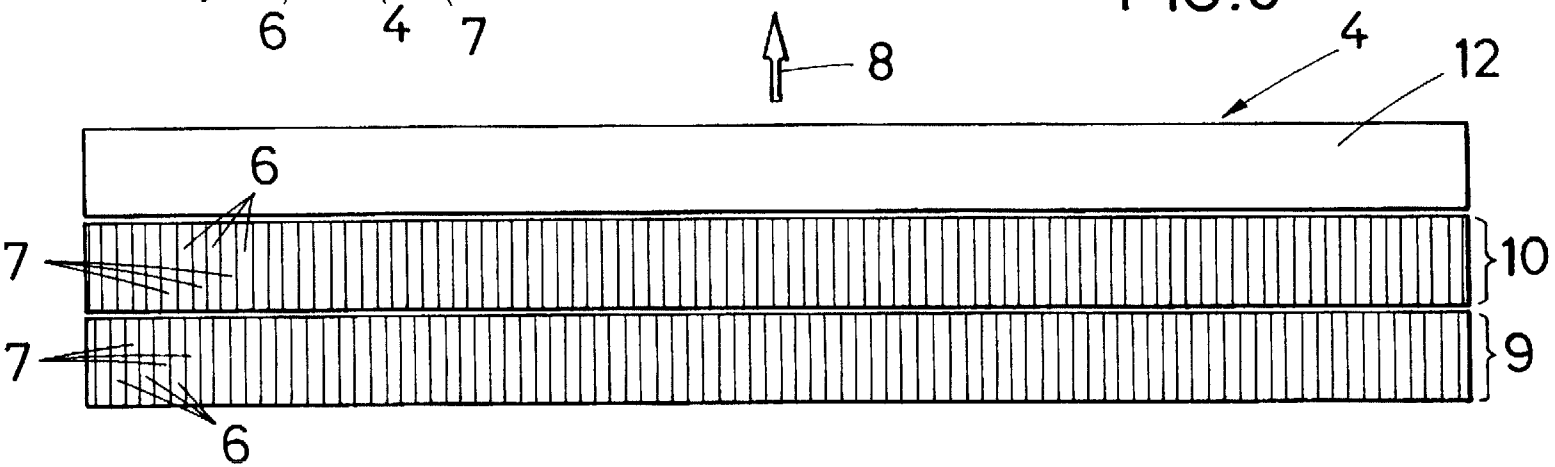
FIG. 6 is a top view of another embodiment of the support surface according to the invention.
Figure 7:
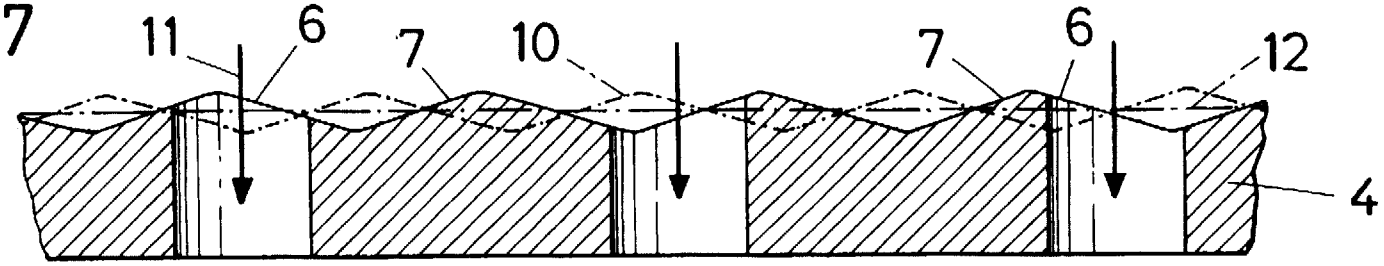
FIG. 7 is a fragmentary section taken transversely to the direction of passage of the fibrous web through the apparatus, showing the support surface of FIG. 6 on an enlarged scale.

In the embodiment illustrated in FIGS. 6 and 7, further surface sections 7 alternate with surface sections 6 transversely to the one direction in sequential rows 9 and 10, surface sections 6 and further surface sections 7 being arranged side-by-side in a roof-shaped arrangement. As is shown in FIG. 7, surface sections 6 and further surface sections 7 are staggered from each other in rows 9 and 10, row 9 being shown in full lines while row 10 is indicated by phantom lines. Different support surface profiles provide different transverse strengths for the needled fibrous web and also enable the strength to be distributed along the width of the web in any desired manner. The shape and distribution of the inclined support surface sections may be adopted to the desired needling results, and may vary greatly.

As shown in FIG. 6, an additional surface section 12 may adjoin surface sections 6, 7 in the one direction indicated by arrow 8, the additional surface section extending perpendicularly to needling direction 11 so that the intersecting needling on surface sections 6, 7 is complemented by conventional needling in which the needles punch through the fibrous web in a direction extending perpendicularly to the web surface.

If desired, surface sections 6 and further surface sections 7 may be formed on a common perforated support plate. However, the manufacture of the support plates will be facilitated if each row 9, 10 and surface section 12 are provided on separate parts of support 4. In this case, a respective support part may be associated with needle boards 2 sequentially arranged in the one direction indicated by arrow 8.

Figure 8:
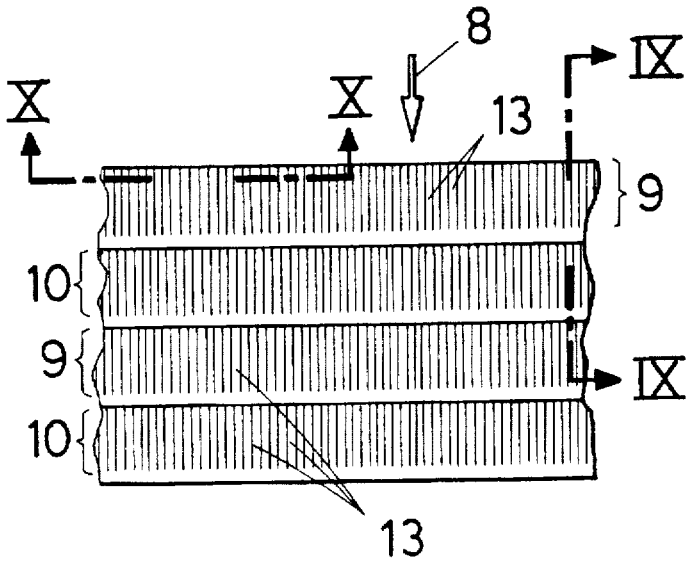
FIG. 8 is a top view of yet another embodiment of the support surface according to the invention.
Figure 9:
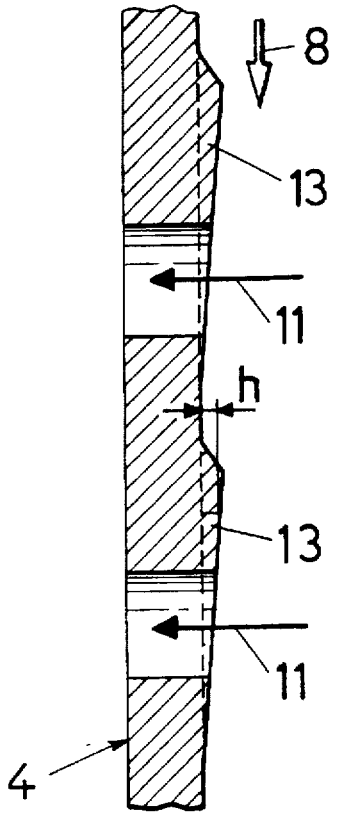
FIG. 9 is a section along line IX—IX of FIG. 8, on an enlarged scale.
Figure 10:
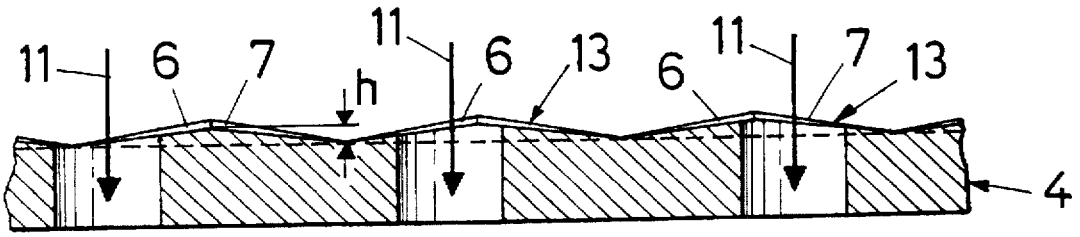
FIG. 10 is a section along line X—X of FIG. 8, on an enlarged scale.

In the embodiment illustrated in FIGS. 8 to 10, ribs 13 extending in the one direction indicated by arrow 8 define surface sections 6, 7. The ribs have changing heights h in the one direction, as shown in FIG. 9. As can be seen in FIG. 10, oppositely inclined surface sections 6, 7 form roof-shaped arrangements. Thus, surface sections 6, 7 are inclined with respect to the needling direction indicated by arrow 11 not only transversely to, but also in, the one direction indicated by arrow 8. In this way, enhanced strength is obtained in the needled fibrous web in a transverse and longitudinal direction, depending on the shape and arrangement of ribs 13.

To obtain an improved intersecting needling, several rows 9, 10 of ribs 13 may adjoin in the one direction, as shown in FIG. 8. In the illustrated embodiment, the ribs in these rows have heights uniformly inclined in the one direction. However, it is also possible to provide rows 9, 10 respectively with ribs 13 having ascending and descending heights in the one direction. Thus, various needling effects may be obtained, for example by staggering the rows of ribs relative to each other.

What is claimed is:

1. An apparatus for needling a fibrous web passing through the apparatus in one direction, which comprises (a) a needle board driven back and forth in a needling direction, and (b) a support opposite the needle board and having a surface facing the needle board, the support surface comprising (1) first surface sections inclined in different directions with respect to the needling direction and transversely to the one direction and (2) further surface sections following the first surface sections in the one direction and inclined in different directions opposite to the directions of inclination of the first sections.

2. The needling apparatus of claim 1, wherein the first surface sections and oppositely inclined further surface sections are arrayed in two rows adjoining in the one direction and extending transversely thereto.

3. The needling apparatus of claim 2, wherein the surface sections in each row are inclined toward one side transversely to the one direction.

4. The needling apparatus of claim 1, wherein the further surface sections alternate with the surface sections transversely to the one direction.

5. The needling apparatus of claim 1, further comprising additional surface sections adjoining the surface sections in the one direction, the additional surface sections extending perpendicularly to the needling direction.

6. The needling apparatus of claim 1, wherein the first surface sections and further surface sections are provided on separate parts of the support.

7. The needling apparatus of claim 1, wherein ribs extending in the one direction define the surface sections, the ribs having changing heights in the one direction.

8. The needling apparatus of claim 7, wherein rows of said ribs adjoining in the one direction have heights uniformly inclined in the one direction.

9. The needling apparatus of claim 8, comprising at least two rows of said ribs having respectively ascending and descending heights in the one direction.

10. The needling apparatus of claim 1, wherein the support surface has a steady curvature in the one direction.

* * * * *